United States Patent [19]

Rymwid et al.

[11] 4,428,804

[45] Jan. 31, 1984

[54] HIGH SPEED BRIGHT SILVER ELECTROPLATING BATH AND PROCESS

[75] Inventors: Yvonne Rymwid, Little Falls; Kenneth Baker, Bridgewater, both of N.J.

[73] Assignee: OMI International Corporation, Warren, Mich.

[21] Appl. No.: 437,057

[22] Filed: Oct. 27, 1982

Related U.S. Application Data

[63] Continuation-in-part of Ser. No. 205,803, Nov. 10, 1980, abandoned.

[51] Int. Cl.[3] ..... C25D 3/46
[52] U.S. Cl. ..... 204/46 R
[58] Field of Search ..... 204/46 R

[56] References Cited

U.S. PATENT DOCUMENTS 3,186,926 6/1965 Hofmann et al. ..... 204/46 R
4,265,715 5/1981 Rosegnen ..... 204/46 R

*Primary Examiner*—Howard S. Williams
*Attorney, Agent, or Firm*—Richard P. Mueller

[57] ABSTRACT

An electrolytic bath for the production of mirror bright silver deposits comprising an alkali metal silver cyanide as the source of silver; boric acid, citric acid, alkali or ammonium metal salts of such acids, as well as mixtures thereof; selenous acid or alkali metal selenite; and, in certain preferred baths, antimony in the form of an alkali metal carboxylic acid salt. The bath is designed to be operated at high current densities of from 200 to 5,000 ASF, i.e. about 20 to 500 ASD. The process of utilizing such as electrolytic bath is also disclosed and claimed.

15 Claims, No Drawings

HIGH SPEED BRIGHT SILVER ELECTROPLATING BATH AND PROCESS

This application is a continuation-in-part of co-pending application Ser. No. 205,803, filed Nov. 10, 1980, now abandoned.

This invention relates to a new and improved electroplating bath and process for the high speed electrodeposition of silver and, more particularly, relates to improved electroplating baths and processes from which mirror bright silver electrodeposits are produced at current densities up to at least as high as 5,000 amperes per square foot.

BACKGROUND OF THE INVENTION

Although the electrodeposition of silver from a variety of plating baths has been disclosed in the art, there is still a need for baths capable of functioning effectively for high speed bright silver plating.

As is well known in the art, silver cyanide plating baths have been employed for many years. Many efforts also have been made to develop noncyanide or low cyanide silver plating baths. See, for example, U.S. Pat. Nos. 4,155,817 (Fletcher) and 4,024,031 (Lerner); where the latter patent is directed to an electroplating bath with a low silver content, which is essentially at a neutral pH and operates substantially without free cyanides.

The patent to Fletcher (U.S. Pat. No. 4,155,817) also contains a detailed description of silver plating. When this is considered, along with the disclosures in the prior art cited in this patent as well as in the Lerner patent, one obtains an excellent background in the historical silver plating art, as well as the numerous endeavors to develop electroplating baths having improved characteristics, including high speed deposition of high quality, bright silver deposits.

The patent to Fletcher discloses, inter alia, the use of a divalent (-2) selenium complex together with an electrolyte bath having a free cyanide content of less than 1.5 g/l. The use of alkali metal selenium compounds as brighteners is also disclosed in U.S. Pat. No. 2,613,179 (Wolfson) and 4,121,982 (Fletcher). Wolfson discloses, inter alia, that the use of a selenite of an alkali metal together with alkali metal cyanides and nitrates results in the formation of a high speed bright silver deposit because of the presence of nitrate (100–150 g/l) and potassium selenite up to 1.0 g/l. Wolfson states that the presence of the nitrates permits him to plate up to 100 ASF (10 ASD) and that without the nitrates this current density could not be achieved.

Another relevant patent for the present purposes is U.S. Pat. No. 2,735,808 (Greenspan) which teaches that the use of a glycerol complex and potassium cyanide are necessary to obtain bright silver deposits from an electroplating which is tartarate-free. Greenspan states that his baths must be tartarate-free when using glycerol complex of antimony.

Furthermore, in U.S. Pat. No. 2,777,810 (Ostrow) there is a disclosure that divalent (-2) selenium compound in the presence of antimony compounds and free cyanide gives bright deposits up to 100 ASF.

In the practice of the inventions of these patents, and particularly those in which divalent or hexavalent selenium compounds are used, either by themselves or in combination with antimony, it has not been possible to obtain bright silver deposits at high current densities.

Specifically, the current densities achieved in the processes of these patents, current density being a measure of plating speed, have not been significantly in excess of about 100 ASF.

Other silver electroplating baths which have been developed are described by Weiner, Alien Property Custodian Ser. No. 351,241; Egeberg et al, U.S. Pat. Nos. 2,176,668; Nobel et al, 2,783,194; Hofmann et al, 3,186,926; and Todt et al, 3,580,821. In each of these, the silver electroplating baths used contain free-cyanide and selenium compounds, including tetravalent seleneium compounds. In the operation of these baths, however, it has not been found to be possible to achieve bright silver electrodeposits at current densities which are significantly in excess of about 100 ASF.

In a more recent development, as described in Rosegren et al, U.S. Pat. No. 4,265,715, significant increases in the operating current densities of a bright silver electroplating bath are obtained using a cyanide-free bath which contains an organic phosphonate compound. With this electroplating bath, plating speeds (current densities) of up to about 2,000 ASF are achieved. While this is a significant improvement over the prior bright silver plating processes, recent advances in this art now require processes which can operate at even higher current densities and still produce a bright silver electrodeposit. Additionally, the use of organic additives in the Rosegren et al process may require more frequent monitoring and/or control of the bath operation than is generally necessary with plating baths based on only metallic additives.

It is, therefore, an object of the present invention to provide an improved electroplating bath and process for the high speed electrodeposition of bright silver deposits.

A further object of the present invention is to provide an electroplating bath and process for the high speed electrodeposition of bright silver deposits which do not utilize organic phosphonate additives in the plating bath.

These and other objects will become apparent to those skilled in the art from the description of the invention which follows.

SUMMARY OF THE INVENTION

The present invention relates to a particular electroplating bath for producing mirror bright silver deposits. More particularly selenium, or combinations of selenium and antimony, are added as additives. The selenium component may be any bath soluble selenium compound in which the selenium is a tetravalent, i.e., has a valence of 4, and in which the anions and/or cations associated with the tetravalent selenium do not have an adverse effect on either the electroplating bath or the silver electrodeposit produced. Generally, it is added as either selenous acid or as an alkali metal or ammonium selenite. Similarly, the antimony component may be any bath soluble compound or complex of antimony in which the anions and/or cations associated with the antimony do not have an adverse effect on either the electroplating bath or the silver electrodeposit produced. Desirably, the antimony component is employed in the form of its complex with an alkali metal carboxylic acid salt. With selenium or both antimony and selenium present, a mirror bright silver deposit results.

The source of silver is an alkali metal or ammonium or amine silver cyanide. Other essential components are boric acid and/or citric acid, or the alkali metal or ammonium salts of such acids. Preferably, for operations at current densities above about 500 ASF, both boric and citric acids are employed, and most preferably, the acids are utilized in the form of their alkali metal salts.

In general, the electroplating bath is substantially free of free cyanide, organic phosphonates and nitrate ions. It is formulated to have a pH within the range of about 7.0 to about 9.0; and it will be operated within a temperature range of about 20° to about 80° C. and at a high current density of up to about 5,000 ASF.

The silver will be present in the bath in an amount which is at least sufficient to produce a smooth electrodeposit of silver on the substrate. The citrate and borate will be present in amounts which are at least sufficient, either alone or in combination, to effect buffering of the bath to maintain it within the desired operable pH range. The selenium and antimony will be present in amounts which are at least sufficient to produce a bright electrodeposit of silver.

DETAILED DESCRIPTION OF THE INVENTION

As previously set forth, the goal of the present invention is to provide an electroplating bath, which can be operated at high speed up to 5,000 ASF to produce a mirror bright silver deposit on various substrates or workpieces such as copper alloys, nickel alloys, and the like.

The source of the silver in the bath is desirably an alkali metal or ammonium or amine silver cyanide. Although ammonium, potassium, sodium, and lithium silver cyanides may be employed, the most preferred is potassium silver cyanide. It will be further understood that for purposes of the present invention wherever the use of an alkali metal is prescribed, potassium is especially preferred unless otherwise indicated.

The amount of silver, derived from the potassium silver cyanide, typically will range from about 20 to 120 g/l, preferably from 30 to 100 g/l.

The citric acid or its alkali metal or ammonium salt, preferably potassium citrate, will be employed in amounts typically ranging from about 20 to 200 g/l, preferably 40 to 150 g/l.

The boric acid or its alkali metal or ammonium salt, which for operations at current densities above about 500 ASF, will be employed not in place of the citric acid or its alkali metal salt but rather in conjunction with citric acid, typically will be utilized in amounts ranging from about 10 to 80 g/l, preferably 15 to 60 g/l. Again, the preferred boric acid component will be its potassium metal salt, namely potassium borate, or boric acid itself.

The selenium component is desirably selenous acid ($H_2SeO_3$) or an alkali metal or ammonium selenium salt wherein the valence is 4 (i.e. tetravalent) rather than divalent as prescribed in the prior art teaching described above. The selenium component typically will be utilized in the bath in amounts ranging from about 0.02 to 5 g/l, and preferably about 0.03 to 4 g/l. In forming the alkali metal salt, the selenous acid is merely neutralized with an alkali metal material such as the hydroxide. Thus, for example, potassium hydroxide may be readily employed to neutralize the selenous acid. Based on selenium metal alone, typically the bath will contain 0.01 to 3 g/l, and preferably 0.02 to 2 g/l.

For certain purposes of this invention, an antimony component is also employed in the bath to ensure the deposition or mirror bright silver deposits. Preferably the antimony is used in the form of an alkali metal carboxylic acid complex, and most preferably as potassium antimony tartrate. Other complexes that could be employed in the present invention include antimony potassium glycerate, antimony oxide dissolved in other carboxylic acids, and the like. The amount of antimony metal used in the bath typically will range from about 0.5 to 2.5 g/l, preferably 1.0 to 1.5 g/l.

It is an important feature of the present invention that the resulting electroplating bath be substantially free of free cyanide, organic phosphonates and nitrate ions, which is another distinction between the present invention and the known baths of the prior art. By substantially free of free cyanide, organic phosphonates and nitrate ions, one means a content of each of these of less than about 1.5 g/l, and preferably less than about 0.25 g/l.

A preferred bath compositions of the present invention is set forth below:

| Component | Concentration, g/l |
|---|---|
| Silver (as potassium silver cyanide) | 38–76 |
| Potassium Citrate | 40–150 |
| Boric Acid | 15–60 |
| Selenium (as $H_2Se0_3$) | 0.02–2 |
| Antimony (as potassium antimony tartrate) | 1–1.5 |

The pH of the bath typically may range from about 7.0 to 9.0, preferably 7.5 to 8.5; while the temperature typically is maintained with the range of 20° to 80° C., preferably about 40° to 70° C. As described above, the current density may be relatively high, i.e. up to 5,000 ASF. Although the current density employed may be as low as 100, in order to ensure the production of mirror bright silver deposits the densities will preferably range from about 200 to 5,000 ASF, i.e. about 20 to 500 A/dm$^2$ (ASD).

The invention will be more fully understood by reference to the following illustrative embodiments.

EXAMPLE 1

An electrolytic bath was prepared having the following formulation:

| | |
|---|---|
| Silver as potassium silver cyanide | 60 g/l |
| Potassium citrate | 100 g/l |
| Boric Acid | 30 g/l |
| Selenium as Selenous acid | 2.0 g/l |

This electrolyte at 70° C. deposited mirror bright plates when selectively plated at current densities between 1,000 to 4,000 ASF on copper alloys. The pH of the bath was 8.

EXAMPLE 2

The same formulation given in Example 1, but operated at 50° C., plated selectively mirror bright deposits between 400 and 1500 ASF.

EXAMPLE 3

The same formulation given in Example 1, but operated at 30° C., plated selectively mirror bright deposits between 200 and 400 ASF.

EXAMPLE 4

The procedure of Example 3 is repeated except that the potassium citrate is omitted from the bath and similar results are obtained.

EXAMPLE 5

The procedure of Example 3 is repeated except that the boric acid is omitted from the bath and similar results are obtained.

EXAMPLE 6

An electrolytic bath was prepared having the following formulation:

| | |
|---|---|
| Silver as potassium silver cyanide | 80 g/l |
| Potassium citrate | 75 g/l |
| Boric acid | 20 g/l |
| Selenium as selenous acid | 2.0 g/l |
| Antimony as potassium antimony tartrate | 1.5 g/l |

This electrolyte, when operated at 60° C. selectively plated mirror bright silver deposits from 1,000 to 5,000 ASF.

EXAMPLE 7

An electrolytic bath was prepared having the following formulation:

| | |
|---|---|
| Potassium Silver Cyanide | 100 g/l |
| Potassium Citrate | 50 g/l |
| Boric Acid | 50 g/l |
| Selenium, as selenous acid | 1.5 g/l |

This electrolyte was operated as in Example 6 and similar results were obtained.

EXAMPLE 8

An electrolytic bath was prepared having the following formulation:

| | |
|---|---|
| Potassium Silver Cyanide | 100 g/l |
| Potassium Citrate | 100 g/l |
| Boric Acid | 30 g/l |
| Selneium, as selenous acid | 1.8 g/l |

This electrolyte was operated as in Example 6 and similar results were obtained.

The above data demonstrates that the electrolytic baths of the present invention give outstanding silver deposits. By way of comparison, it was found that when the selenous acid or salt of the illustrative embodiment was substituted with a selenide (where the selenium is divalent) or selenate (where the selenium is hexavalent) the thus formed electrolytes did not give mirror bright or bright silver deposits when plated selectively at a current density of over 500 ASF.

While certain features of the present invention has been illustrated above, it will be understood that the invention is obviously subject to variations and modifications without departing from the broader aspects of the invention.

What is claimed is:

1. An aqueous, stable electroplating bath suitable for high speed production of mirror bright silver deposits at high current densities of up to about 5,000 ASF, said aqueous bath being substantially free of free cyanide, organic phosphonate and nitrate ions, and comprising the following components:

a. an alkali metal, ammonium or amine silver cyanide;

b. a component selected from the group consisting of citric acid, boric acid, alkali metal salts of citric or boric acid, ammonium salts of citric or boric acid, and mixtures thereof; and c. a bath soluble selenium compound in which the selenium has a valence of 4.

2. The electroplating bath of claim 1 wherein the selenium compound is selected from the group consisting of selenous acid, and that alkali metal and ammonium salts of selenous acid.

3. The electroplating bath of claim 2, wherein the bath also contains antimony in the form of an alkali metal carboxylic acid complex thereof.

4. The electroplating bath of claim 3, wherein the antimony is in the form of potassium carboxylic acid salt complex.

5. The electroplating bath of claim 4, wherein the antimony complex is potassium antimony tartrate.

6. The electroplating bath of claim 2, wherein the bath contains potassium silver cyanide.

7. The electroplating bath of claim 2, wherein the bath contains both an alkali metal citrate and boric acid.

8. The electroplating bath of claim 7, wherein the bath contains potassium citrate and boric acid.

9. The electroplating bath of claim 2, wherein the selenium compound is selenous acid.

10. The electroplating bath of claim 2, wherein the selenium compound is an alkali metal selenite.

11. The electroplating bath of claim 1, wherein the bath also contains a bath soluble compound or complex of antimony.

12. The electroplating bath of claim 1, having a pH of from about 7.0 to 9.0.

13. A method of electrodepositing bright silver on a substrate which comprises passing an electric current between a cathode and an anode through an electroplating bath as claimed in claim 1 at a current density of from about 200 to about 5,000 ASF for a period of time sufficient to deposit the desired thickness of bright silver.

14. The method of claim 13 wherein the bath also contains a bath soluble compound or complex of antimony.

15. The method of claim 13 wherein the bath contains an alkali metal citrate and boric acid.

* * * * *